US009146525B2

(12) United States Patent
Ruiz et al.

(10) Patent No.: US 9,146,525 B2
(45) Date of Patent: Sep. 29, 2015

(54) APPARATUS AND METHOD FOR CLEANING AN IMAGING SURFACE OF A PRINTING SYSTEM

(71) Applicant: XEROX CORPORATION, Norwalk, CT (US)

(72) Inventors: Erwin Ruiz, Rochester, NY (US); Jeffrey Nyyssonen Swing, Rochester, NY (US); David S. Derleth, Webster, NY (US); Charles T. Facchini, II, Webster, NY (US); Steven Russel, Bloomfield, NY (US); Jorge M. Rodriguez, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/664,632

(22) Filed: Oct. 31, 2012

(65) Prior Publication Data

US 2014/0119800 A1 May 1, 2014

(51) Int. Cl.
*G03G 21/00* (2006.01)

(52) U.S. Cl.
CPC ..... *G03G 21/0035* (2013.01); *G03G 21/0041* (2013.01)

(58) Field of Classification Search
USPC ..... 399/123, 346, 343; 15/256.51, 256.5, 15/256.52, 21.1
See application file for complete search history.

(56) References Cited

U.S. PATENT DOCUMENTS

| | | | | |
|---|---|---|---|---|
| 5,492,550 | A * | 2/1996 | Krishnan et al. | 51/298 |
| 5,655,203 | A | 8/1997 | Thayer et al. | |
| 5,701,572 | A | 12/1997 | Behe et al. | |
| 6,514,363 | B2 * | 2/2003 | Close | 156/83 |
| 6,949,019 | B2 * | 9/2005 | Wentworth et al. | 451/466 |
| 7,347,771 | B2 * | 3/2008 | Wentworth et al. | 451/466 |
| 7,551,884 | B2 * | 6/2009 | Watanabe et al. | 399/350 |
| 8,078,075 | B2 * | 12/2011 | Kim | 399/71 |
| 8,428,481 | B2 * | 4/2013 | Thayer et al. | 399/71 |
| 2010/0086604 | A1 * | 4/2010 | Stellacci et al. | 424/489 |
| 2012/0155929 | A1 | 6/2012 | Barton et al. | |

FOREIGN PATENT DOCUMENTS

| | | | | |
|---|---|---|---|---|
| DE | 20 2011002349 | * | 1/2012 | H01R 39/20 |
| JP | 2006267481 | * | 10/2006 | |

OTHER PUBLICATIONS

Yuan et al., Superwetting nanowire membranes for selective absorption, Nature Nanotechnology 3, 332-336 (2008).*
Machine translation for JP2006-267481.*
MIT researchers make oil-eating nanotech paper towel, Mass High Tech—Boston Business Journal, May 30, 2008 (URL: http://www.bizjournals.com/boston/blog/mass-high-tech/2008/05/mit-researchers-make-oil-eating-nanotech.html).*
Machine translation into English of DE 20 2011002349.*

* cited by examiner

*Primary Examiner* — Walter L Lindsay, Jr.
*Assistant Examiner* — Arlene Heredia Ocasio
(74) *Attorney, Agent, or Firm* — Ronald E. Prass, Jr.; Prass LLP

(57) ABSTRACT

An apparatus and method are provided for cleaning an imaging surface of a printing system by way of a cleaning member having a nanowire mesh portion configured to contact the imaging surface.

26 Claims, 4 Drawing Sheets

APPARATUS AND METHOD FOR CLEANING AN IMAGING SURFACE OF A PRINTING SYSTEM

FIELD OF DISCLOSURE

The disclosure relates to an apparatus and method for cleaning an imaging surface of a printing system.

BACKGROUND

Various printing processes form an image on a substrate by way of an imaging surface such as, for example, a photoreceptor. The imaging surface may become contaminated over time. Such contamination often causes image related defects.

SUMMARY

Therefore, there is a need for an apparatus and method to clean an imaging surface of a printing system.

According to one embodiment, an apparatus for cleaning an imaging surface of a printing system comprises a cleaning member having a nanowire mesh portion configured to contact the imaging surface.

According to another embodiment, a method for cleaning an imaging surface of a printing system comprises causing, at least in part, a cleaning member having a nanowire mesh portion to contact the imaging surface.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments of the invention are illustrated by way of example, and not by way of limitation, in the figures of the accompanying drawings.

DETAILED DESCRIPTION

Examples of an apparatus and method for cleaning an imaging surface of a printing system are disclosed. In the following description, for the purposes of explanation, numerous specific details are set forth in order to provide a thorough understanding of the embodiments of the invention. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

As used herein, the term "print job attribute," and any derivation thereof, refers to any descriptive property of a print job to be processed by a printing system. For example, a print job may be a simplex (one-sided printing) or duplex (two-sided printing) type, a print job may have a particular run length, a print job may have a predetermined expected quality threshold, etc.

As used herein, the term "imaging surface," and any derivation thereof, shall mean any member, such as a platen, belt, or drum, which accepts marking material, such as ink or toner, in imagewise fashion for eventual transfer to a print medium and subsequent cleaning. Although the illustrated embodiments shows an imaging surface as part of a photoreceptor belt used in image-on-image electrophotography, it will be understood that imaging surfaces, as the term is used herein, are apparent in other types of printing apparatus, such as an intermediate belt as used in tandem color electrophotography, a charge receptor such as used in ionography, or an intermediate drum or belt such as used in any type of ink jet printing.

As used herein, the term "nanowire mesh," and any derivation thereof, refers to a material configured to absorb an oil by way of capillary action. A nanowire mesh material includes a plurality of nanowires having diameters on the order of tens of nanometers, or less, and lengths that are unconstrained. For example, a nanowire mesh material may comprise a plurality of nanowires having diameters ranging between 10 nm and 100 nm. The nanowires may have the same or unequal diameters in a same nanowire mesh. The nanowires may also have lengths of 1,000 times or more a given diameter. The nanowires may have the same or unequal lengths in a same nanowire mesh. A nanowire mesh may take any form such as, but not limited to, a paper-like or a web-like form, or any form of which may be used, for example, to form bristles of a brush. A nanowire mesh material may comprise any number of materials including, but not limited to, metallic materials, non-metallic materials, polymers, ceramics, glasses, conducting materials, semiconducting materials, non-conducting materials, or any combination thereof. For example, the interwoven nanowire fibers may comprise a potassium manganese oxide.

Figure 1:
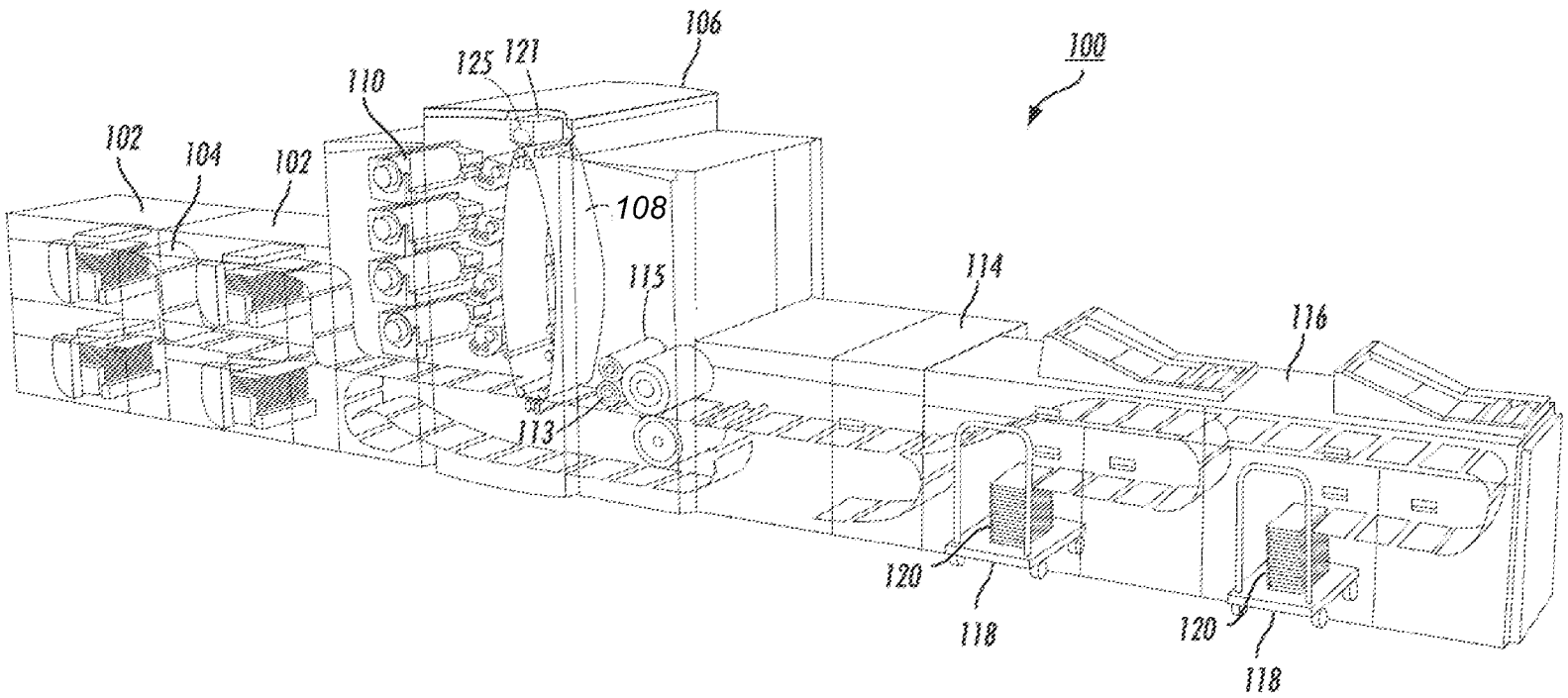
FIG. 1 is a diagram of a printing system having an imaging surface and a cleaning unit, according to one embodiment.

FIG. 1 illustrates a printing system 100 having a cleaning unit 121 capable of cleaning an imaging surface 108 of the printing system 100, according to one embodiment. The printing system 100 can be used to apply images to many types of media, or substrates, having various sizes and weights. The printing system 100 includes two media feeder modules 102 arranged in series, a printer module 106 adjacent the media feeder modules 102, an inverter module 114 adjacent the printer module 106, and two stacker modules 116 arranged in series adjacent the inverter module 114.

In the printer module 106, marking material (e.g., toner) is transferred from a series of developer stations 110 to the imaging surface 108 which may be, for example, a charged photoreceptor, to form toner images on the imaging surface 108 and produce the above-mentioned images on the media. The toner images are transferred to one side of media 104 fed through the paper path. The media are advanced through a fixing device that includes a fixing roll 113 and pressure roll 115. The fixing roll 113 and the pressure roll 115 together forms a nip. At the nip, heat and pressure are applied to media on which marking material has been applied to fix the marking material to the media.

The inverter module 114 manipulates media exiting the printer module 106 by either passing the media through to the stacker modules 116 in a case of simplex printing, or inverting and returning the media to the printer module 106 for duplex printing. In the stacker modules 116, the printed media are loaded onto stacker carts 118 to form stacks 120.

The imaging surface 108 can be contaminated by various types of debris and/or printing process byproducts such as excess toner, paper dust, environmental contaminants, and/or release agent, for example. Release agent is often applied to the fixing roll 113 by the printing system 100 to aid in stripping the media from the fixing roll 113 following the above-mentioned fixing process. The release agent, however, may be carried back to the imaging surface 108 when the printing system 100 is operating in a duplex printing mode.

Image related defects such as, but not limited to, ghosting, often occur when the imaging surface is contaminated. Image related defects cause print production delays and reduce production efficiency. For example, a printing process may need to be stopped and started, or delayed, to correct any detected image related defects.

Conventional solutions for correcting the image defect problem include running clean up sheets through a conventional printing system to clean the imaging surface 108. For example, the clean up sheets may be used to absorb any release agent that has built up on the imaging surface 108, and/or a cleaning blade may be used to scrape any built up release agent from the imaging surface 108. Neither solution, however, effectively cleans the imaging surface 108 to eliminate the above-mentioned image related defects. Other solutions include replacing the imaging surface 108 and/or the fixing roll 113, for example. Such replacement solutions are expensive and time consuming.

To address these problems, the printing system 100 includes the cleaning unit 121 capable of cleaning the imaging surface of any contaminants such as the debris and/or release agent, discussed above. While FIG. 1 illustrates the cleaning unit 121 as being part of the printing system 100, the cleaning unit 121 may alternatively be configured to be a modular unit that can be retrofitted to clean the imaging surface 108 of a printing system that does or does not include a cleaning unit 121.

According to various embodiments, the cleaning unit 121 has at least one cleaning member 125 that may be one or more of a brush-type and/or a web-type configured to contact the imaging surface 108.

Regardless of form of the cleaning member 125, the cleaning member 125 includes at least one nanowire mesh portion. For example, one or more bristles of a brush-type cleaning member 125 may be comprised of a nanowire mesh material, or all the bristles of a brush-type cleaning member 125 may be comprised of a nanowire mesh material. Similarly, a web-type cleaning member 125 may be comprised entirely of a nanowire mesh material, or the web-type cleaning member 125 may have one or more portions comprising a nanowire mesh material.

Nanowire mesh materials are capable of absorbing up to 20 times their weight in release agent, and serve to effectively clean the imaging surface 108 to reduce or eliminate any image related defects caused by release agent build up and/or debris on the imaging surface 108. In addition to, or as an alternative of, the nanowire mesh material, any or all of the bristles of a brush-type cleaning member 125, or any or all portions of a web-type cleaning member 125 may comprise a silicon material or any other similar high absorbing material.

According to various embodiments, the cleaning member 125 may be fixed so that the cleaning member 125 is always in contact with the imaging surface 108, or movable so that the cleaning unit 121 may selectively clean the imaging surface 108.

If the cleaning member is movable, the cleaning member 125 may be caused to be moved away from the imaging surface 108 so that it only contacts the imaging surface 108 on demand, or as instructed, based on a particular determined print job attribute such as a determined type of print job (i.e. simplex or duplex), determined print job length, a print job known to have a large or small amount of release agent coverage and carry back, a determined image quality threshold that may be set by an operator or detected by a sensor, or for any other reason that may affect image quality performance of the printing system. Such movement of the cleaning member 125 between an engaged cleaning position in contact with the imaging surface 108 and a disengaged position may reduce any wear that the cleaning member 125 and/or the imaging surface 108 may experience from any cleaning processes.

According to various embodiments, the cleaning unit 121 may index the positioning of the cleaning member 125 between the engaged position and the disengaged position by any of a camming mechanism, a solenoid loading mechanism, or any other type of motor or means for inducing a movement of the cleaning member 125.

According to various embodiments, if the cleaning member 125 is movable, the cleaning member 125 may be caused to contact the imaging surface 108 any combination of continually, periodically, before a print job, during a print job, after a print job, or during a warm-up or cool-down cycle of the printing system 100. In some embodiments, the cleaning member 125 may be used to not only clean the imaging surface 108, but also to condition the imaging surface 108 as necessary.

Figure 2:
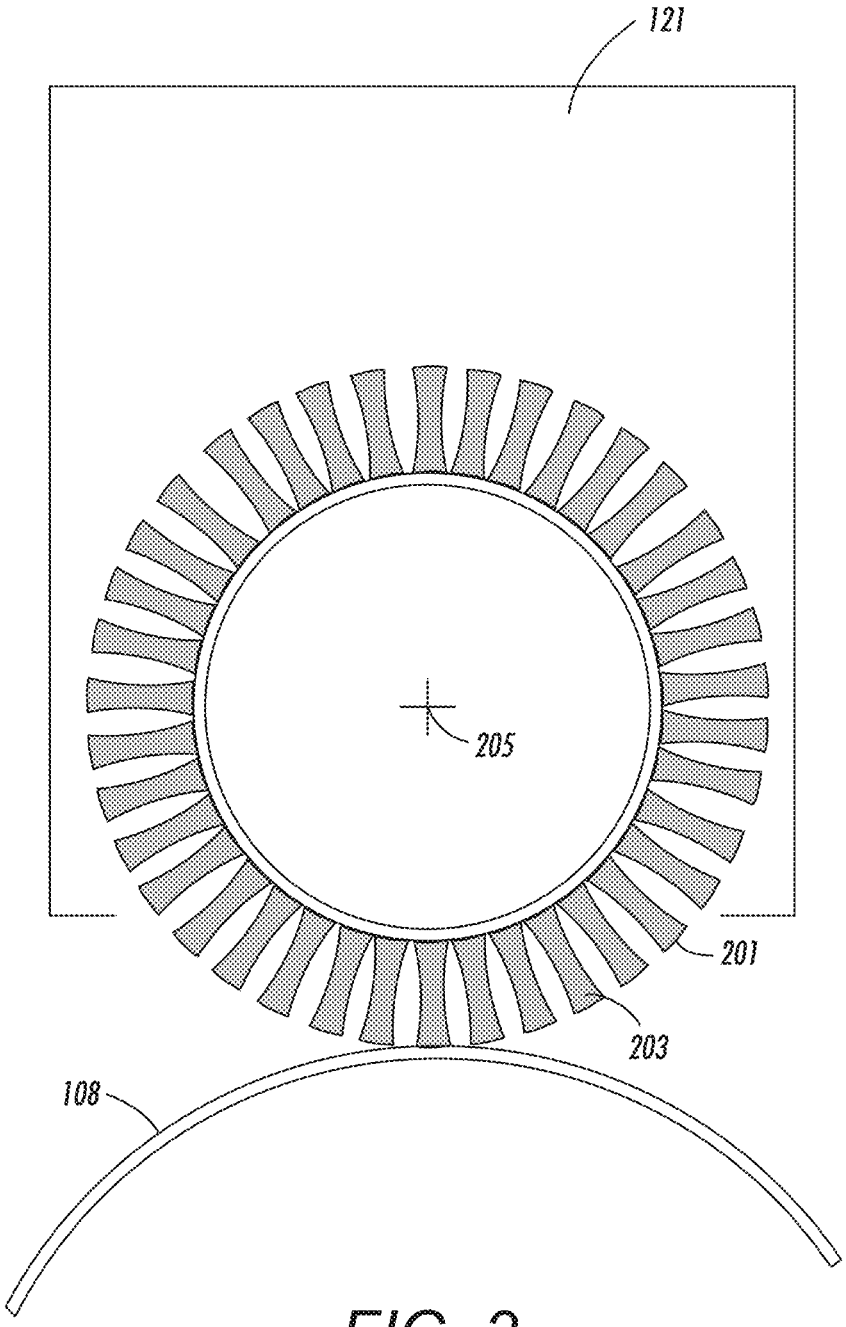
FIG. 2 is a diagram of the components of a cleaning unit having a cleaning brush, according to one embodiment.

FIG. 2 is a diagram of an example embodiment of the cleaning member 125. In this example, the cleaning member 125 of the cleaning unit 121 is illustrated as being a cleaning brush 201 having bristles 203. As discussed above, the cleaning brush 201 includes a nanowire mesh portion. For example, one or more bristles 203 of the cleaning brush 201 may be comprised of nanowire mesh, or all the bristles 203 of the cleaning brush 201 may be comprised of a nanowire mesh material. In addition to, or as an alternative of, the nanowire mesh material, any or all of the bristles 203 of the cleaning brush 201 may comprise a silicon brush material, for example, or any other similar high absorbing material. The cleaning brush 201 is configured to be a rotary brush that rotates about a center axis 205.

Figure 3:
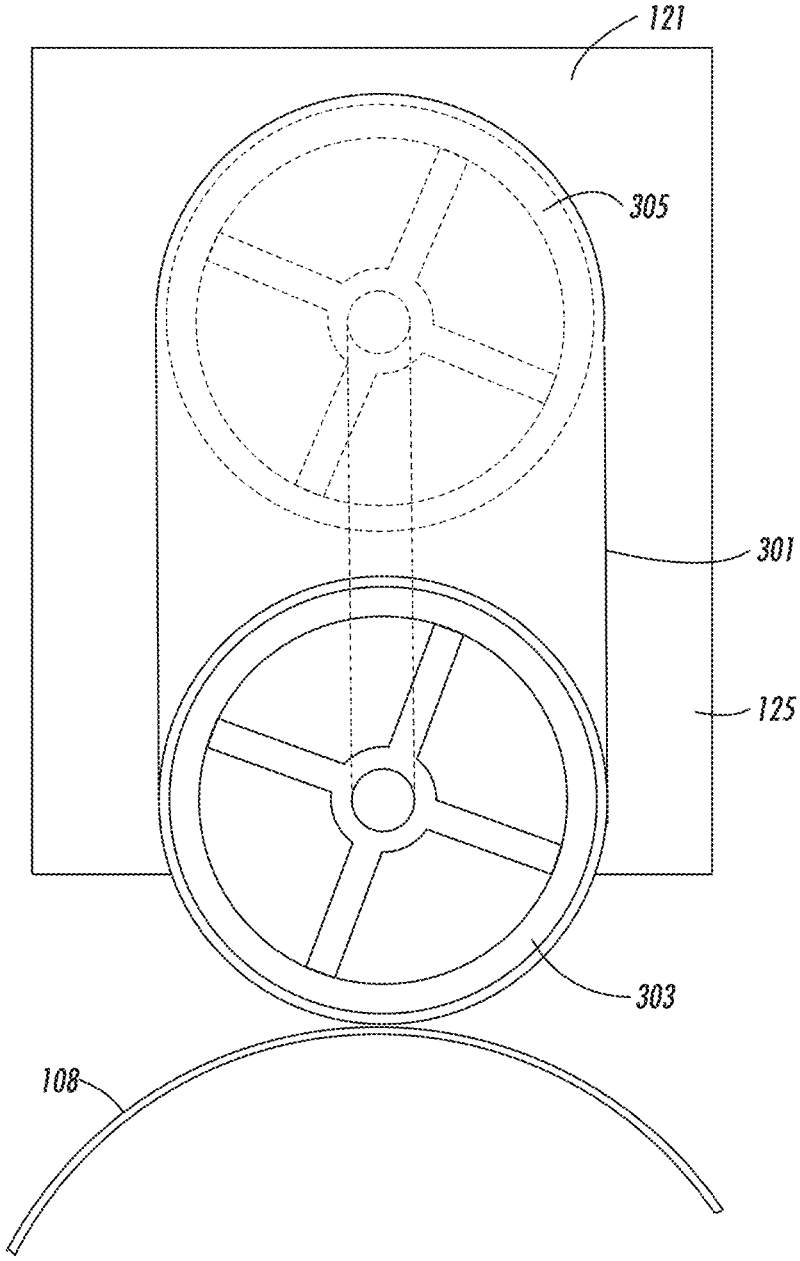
FIG. 3 is a diagram of the components of a cleaning unit having a cleaning web, according to one embodiment.

FIG. 3 is a diagram of an example embodiment of the cleaning member 125. In this example, the cleaning member 125 is illustrated as being a cleaning web 301 that is advanced around a cleaning roller 303 and a guide roller 305. The cleaning unit 121 may include more than the two rollers that are illustrated, or simply have a single roller around which the cleaning web 301 is wrapped. In some embodiments, the cleaning web 301 may be continuously reused, while in other embodiments, the cleaning web 301 may be caused to contact the imaging surface 108 and wound by the guide roller 305, for example, after a particular portion of the cleaning web 301 is used to clean the imaging surface 108. As discussed above, the cleaning web 301 may be comprised entirely of a nanowire mesh material, or the cleaning web 301 may have one or more nanowire mesh portions. In addition to, or as an alternative of, the nanowire mesh material, any or all portions of the cleaning web 301 may comprise a silicon material, for example, or any other similar high absorbing material.

Figure 4:
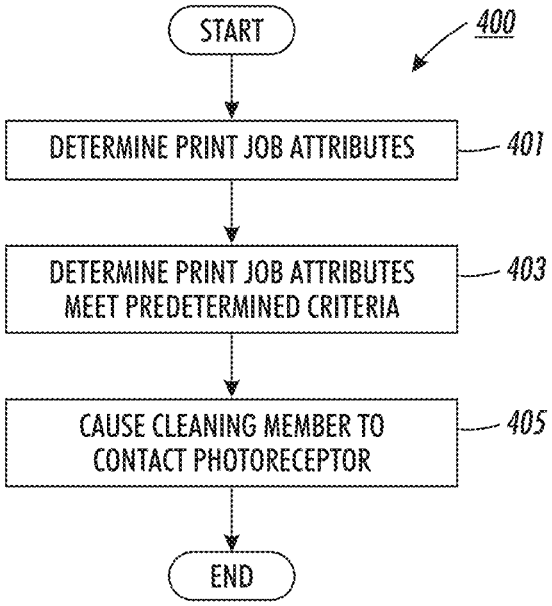
FIG. 4 is a flowchart of a process for cleaning an imaging surface of a printing system, according to one embodiment.

FIG. 4 is a flowchart of a process for cleaning an imaging surface of a printing system, according to one embodiment. In one embodiment, the cleaning unit 121, discussed above, performs the process 400. In step 401, the cleaning unit 121 determines a print job attribute associated with a print job to be processed by the printing system 100, discussed above. Then, in step 403, the cleaning unit 121 determines the print job attribute meets a predetermined criteria. According to various embodiments, the predetermined criteria includes at least one or more of a threshold level of release agent applied to a substrate while processing the print job, a type of the print job, and a length of the print job. Each criteria may be preset to correspond to a particular value that triggers cleaning unit 121 to cause the cleaning member 125 to contact the imaging surface 108, discussed above.

Next, in step 405, the cleaning unit 121 causes, at least in part, the cleaning member 125 to contact the imaging surface 108 in response to the determination that the print job attribute meets the predetermined criteria or on demand. According to various embodiments, depending on operator preference and/or any determined print job attributes, the cleaning member 125 may be caused to contact the imaging surface 108 during, before or after a print job, during a warm-up or cool-down cycle of the printing system 100, on demand, or any combination thereof.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. An apparatus for cleaning an imaging surface of a printing system, the apparatus comprising:

a rotating cleaning member having a central hub; and a plurality of extension members extending radially from the central hub, each of the extension members being a nanowire mesh configured to contact the imaging surface as the rotating cleaning member rotates, wherein the nanowire mesh is absorbent by way of capillary action.

2. An apparatus of claim 1, wherein the cleaning member is configured to contact the imaging surface in response to a determination that a print job attribute associated with a print job to be processed by the printing system meets a predetermined criterion.

3. An apparatus of claim 2, wherein the predetermined criterion includes a threshold level of release agent applied to a substrate while processing the print job.

4. An apparatus of claim 2, wherein the predetermined criterion includes a type of the print job.

5. An apparatus of claim 2, wherein the predetermined criterion includes a length of the print job.

6. An apparatus of claim 1, wherein the cleaning member is configured to contact the imaging surface during a print job.

7. An apparatus claim 1, wherein the cleaning member is configured to contact the imaging surface during a warm-up cycle of the printing system.

8. An apparatus of claim 1, wherein the cleaning member is configured to contact the imaging surface on demand.

9. An apparatus of claim 1, wherein the nanowire mesh comprises a plurality of nanowires having one or more respective diameters that are less than or equal to 100 nm.

10. An apparatus of claim 9, wherein the plurality of nanowires have one or more respective lengths that are greater than or equal to 1000 times a corresponding respective diameter.

11. An apparatus of claim 1, wherein the nanowire mesh comprises potassium manganese oxide.

12. An apparatus of claim 1, wherein a first one of the extension members is formed from a plurality of nanowires.

13. An apparatus of claim 12, wherein the plurality of nanowires that form the first one of the extension members are entangled nanowires that form the mesh.

14. A method for cleaning an imaging surface of a printing system, the method comprising:

causing, at least in part, a rotating cleaning member to rotate and to contact the imaging surface, the rotating cleaning member having a central hub; and a plurality of extension members extending radially from the central hub, each of the extension members being a nanowire mesh configured to contact the imaging surface as the rotating cleaning member rotates, wherein the nanowire mesh is absorbent by way of capillary action.

15. A method of claim 14, further comprising:

determining a print job attribute associated with a print job to be processed by the printing system;

determining the print job attribute meets a predetermined criterion; and causing, at least in part, the cleaning member to contact the imaging surface in response to the determination that the print job attribute meets the predetermined criterion.

16. A method of claim 15, wherein the predetermined criterion includes a threshold level of release agent applied to a substrate while processing the print job.

17. A method of claim 15, wherein the predetermined criterion includes a type of the print job.

18. A method of claim 15, wherein the predetermined criterion includes a length of the print job.

19. A method of claim 14, wherein the cleaning member is configured to contact the imaging surface during a print job.

20. A method of claim 14, wherein the cleaning member is configured to contact the imaging surface during a warm-up cycle of the printing system.

21. A method of claim 14, wherein the cleaning member is configured to contact the imaging surface on demand.

22. A method of claim 14, wherein the nanowire mesh comprises a plurality of nanowires having one or more respective diameters that are less than or equal to 100 nm.

23. A method of claim 22, wherein the plurality of nanowires have one or more respective lengths that are greater than or equal to 1000 times a corresponding respective diameter.

24. A method of claim 14, wherein the nanowire mesh comprises potassium manganese oxide.

25. An method of claim 14, wherein a first one of the extension members is formed from a plurality of nanowires.

26. An method of claim 25, wherein the plurality of nanowires that form the first one of the extension members are entangled nanowires that form the mesh.

* * * * *